US007295793B2

(12) United States Patent
Palmer et al.

(10) Patent No.: US 7,295,793 B2
(45) Date of Patent: Nov. 13, 2007

(54) ELECTROPHOTOGRAPHIC REPRODUCTION SYSTEM WITH A MULTIFACETED CHARGING MECHANISM

(75) Inventors: Daniel R. Palmer, Rochester, NY (US); Douglas W. DeHollander, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 274 days.

(21) Appl. No.: 11/081,426

(22) Filed: Mar. 16, 2005

(65) Prior Publication Data

US 2005/0214026 A1 Sep. 29, 2005

Related U.S. Application Data

(60) Provisional application No. 60/553,741, filed on Mar. 17, 2004.

(51) Int. Cl.
*G03G 21/18* (2006.01)

(52) U.S. Cl. ..... 399/115; 250/324

(58) Field of Classification Search ..... 399/50, 399/115, 168–173; 250/324–326
See application file for complete search history.

(56) References Cited

U.S. PATENT DOCUMENTS 4,056,723 A * 11/1977 Springett et al. ..... 250/324

* cited by examiner

*Primary Examiner*—David M. Gray
*Assistant Examiner*—Ruth N. LaBombard
(74) *Attorney, Agent, or Firm*—Donna P. Suchy

(57) ABSTRACT

A charging mechanism for an electrophotographic reproduction system has a charger cartridge inserted into a charger sleeve. The charger cartridge has multiple facets, each with a corona charger. The charger cartridge is positioned in the charger sleeve to have the corona charger of one facet adjacent to a photoconductor in the electrophotographic reproduction system. The charger cartridge may be repositioned in the charger sleeve to have another corona charger from another facet adjacent to the photoconductor.

30 Claims, 10 Drawing Sheets

ELECTROPHOTOGRAPHIC REPRODUCTION SYSTEM WITH A MULTIFACETED CHARGING MECHANISM

CROSS REFERENCE TO RELATED APPLICATIONS

This is a 111A application of U.S. Provisional Application Ser. No. 60/553,741, filed Mar. 17, 2004, entitled "ELECTROPHOTOGRAPHIC REPRODUCTION SYSTEM WITH A MULTIFACETED CHARGING MECHANISM" by Daniel R. Palmer, et al.

FIELD OF THE INVENTION

This invention generally relates to image-forming systems having a corona charger. More particularly, this invention relates to electrophotographic reproduction systems with a corona charger for electrostatically charging a photoconductor.

BACKGROUND OF THE INVENTION

An electrophotographic reproduction system is used to transfer images onto paper or other medium. The electrophotographic reproduction system may be a copier, duplicator, printer, or the like. The images may be analog or digital. The electrophotographic reproduction system typically has a photoconductor, which may have a drum, belt, or other configuration. A belt-type photoconductor usually forms a continuous loop and is mounted on rollers for movement through the electrophotographic reproduction system. A drum-type photoconductor usually forms a cylindrical shape that is mounted on one or more rollers or another device to rotate on its axis in the electrophotographic reproduction system. A photoconductor typically has a photosensitive film layer covering an electrically conductive layer. There may be intermediate layers between the film and conductive layers. The photoconductor usually moves past or through a charging device, an exposure machine, a development station, a transfer mechanism, and a cleaning station. The electrophotographic reproduction system also may have a logic control unit (LCU) or other microprocessor, a graphic user interface, and other components.

As the photoconductor moves through the electrophotographic reproduction system, the charging device electrostatically charges a frame or portion of the photoconductor surface. The exposure machine optically exposes or projects an image onto the frame with the charged surface to form an electrostatic latent image on the photoconductor. The photoconductor moves the electrostatic latent image through the development station, which deposits toner onto the photoconductor. The toner is also is electrostatically charged and thus adheres to the oppositely-charged portions of the electrostatic latent image on the photoconductor. The photoconductor moves the resulting toner image through the transfer mechanism, where the toner image is transferred onto a sheet of paper or other medium. The paper subsequently passes through a fuser device prior to exiting the electrophotographic reproduction system. The fuser device affixes the toner to the sheet using elevated temperature and pressure. The photoconductor is refreshed at the cleaning station in preparation for the next image transfer. The cleaning station removes residual toner and electrostatic charges from the photoconductor.

Many electrophotographic reproduction systems use a corona charger to electrostatically charge the surface of the photoconductor. A corona charger usually has one or more wires positioned in a housing adjacent to the photoconductor. Each wire is held under tension by support members. Multiple wires usually are positioned parallel to each other on separate support members. When a high voltage potential is applied to the wires, a corona or ion field is generated around the wires. The corona causes current to flow to the photoconductor, thus depositing an electrostatic charge on the surface of the photoconductor. The wires may be configured and positioned to deposit a substantially uniform charge on the photoconductor.

The corona charger typically is integrated within a charger assembly for the electrophotographic reproduction system. The charger assembly usually includes other components for operation of the corona charger such as electrical circuitry, controls, and the like. The corona charger also may have a shield, a ground plane, and a grid electrode. The shield partially surrounds the wires without obstructing the area between the wires and the photoconductor. The shield usually is made of an electrically insulative material. The ground plane typically is positioned on the side of the wires that is opposite the photoconductor. The ground plane usually is made of an electrically conductive material. The ground plane may have an applied electrical bias or may be grounded. The grid electrode is positioned between the wires and the photoconductor. The grid electrode may be a conductive plate or sheet with slits or holes such as a mesh, a screen, or the like. The grid electrode also may be a plurality or network of wires. A bias voltage usually is applied to the grid electrode. The bias voltage creates an electric field to control the current flow between the wires and the photoconductor.

With repeated operation of the electrophotographic reproduction system, the wires in the corona charger may deteriorate and may become contaminated. The deterioration and contamination may increase the non-uniformity of the electrostatic charge on the photoconductor beyond acceptable levels for image quality. The deterioration and contamination also may affect the voltage applied to the wires. In addition, the deterioration and contamination may cause corona discharges.

The wires in a corona charger usually are replaced on a frequent basis to avoid or address the affects of deterioration and/or contamination. For some electrophotographic reproduction systems, the charger assembly is discarded and a new charger assembly installed when the wires become or are near to becoming deteriorated or contaminated. The installation of a new charger assembly may increase operating costs, especially in larger or more sophisticated electrophotographic reproduction systems. Operators also may delay the installation of the new charger assembly to avoid the expense. This delay may cause additional maintenance, reduce system durability, and affect image quality.

For other electrophotographic reproduction systems, the individual wires in the corona charger are replaced when the wires become or are near to becoming deteriorated or contaminated. Wire replacement typically is time consuming and results in longer downtime for the electrophotographic reproduction system. Wire replacement usually is done better by a service technician or someone with like experience and/or training. Each wire is physically handled. The old wires are removed from the support members. The new wires are attached to the support members. The new wires may attract contaminants from an installer's hands. In addition, the tension in each wire must be accurately set. The tension controls the vibration frequency of the wires. A change in the vibration frequency may affect image quality and may cause electrical discharges form the corona charger. If there is insufficient tension, the wire may sag and come close enough to cause an electrical discharge to the photoconductor or other components in the electrophotographic reproduction system. If there is too much tension, the wire may break when installed or during later operation of the electrophotographic reproduction system. After the new wires are installed on the support members, the corona charger may need to be installed and aligned properly with the photoconductor. The charger assembly may require additional adjustments.

SUMMARY OF THE INVENTION

This invention provides a charging mechanism for an electrophotographic reproduction system. The charging mechanism has multiple facets, each with a corona charger. The charging mechanism may be repositioned to expose the corona chargers of multiple facets to a photoconductor.

An electrophotographic reproduction system may have a charging mechanism and a photoconductor. The charging mechanism may have a charger sleeve and a charger cartridge. The charger sleeve forms a channel with an aperture positioned adjacent to the photoconductor. The charger cartridge has a first facet and a second facet. The first facet has a first corona charger disposed thereon. The second facet has a second corona charger disposed thereon. The charger cartridge is positioned within the channel of the charger sleeve. The first facet faces the aperture. The charger cartridge may be repositioned in the channel to have the second facet face the aperture.

A charging mechanism for an electrophotographic reproduction system may have a charger sleeve and a charger cartridge. The charger sleeve forms a channel with an aperture. The charger cartridge has at least two facets. Each facet has a corona charger disposed thereon. The charger cartridge is positioned within the channel of the charger sleeve. One facet faces the aperture. The charger cartridge may be repositioned in the channel to have another facet face the aperture.

In a method for electrophotographically reproducing images, a first electrostatic charge is generated on a photoconductor by a first corona charger on a first facet of a charger cartridge in a multifaceted charging mechanism. An image is projected onto the photoconductor. Toner is deposited onto the photoconductor. The toner image is transferred onto a medium. The charger cartridge is repositioned in a charger sleeve of the multifaceted charging mechanism. A second electrostatic charge is generated on a photoconductor by a second corona charger on the second facet of the charger cartridge in the multifaceted charging mechanism.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
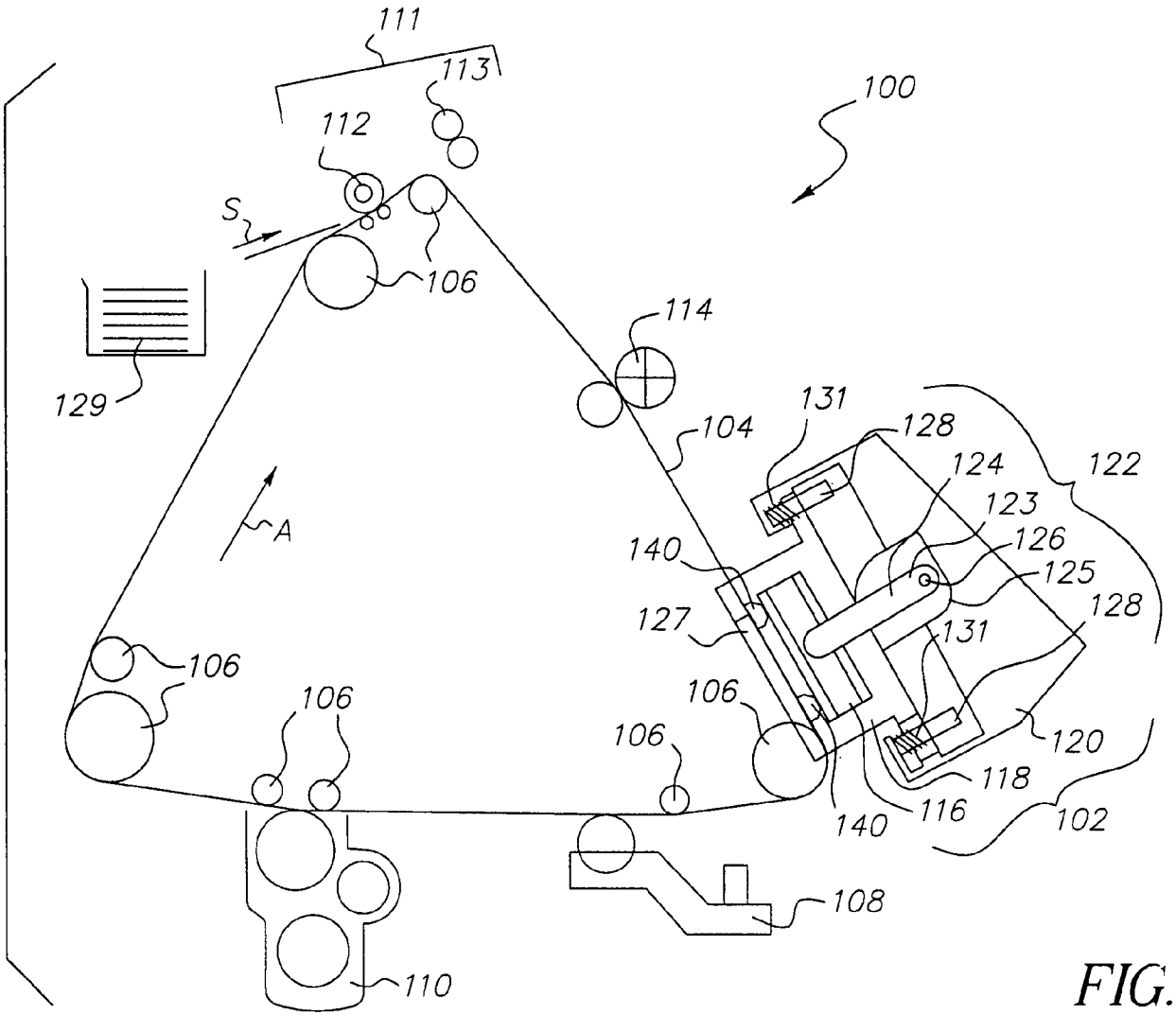
FIG. 1 is a schematic view of an electrophotographic reproduction system with a multifaceted charging mechanism.

FIG. 1 is a schematic view of an electrophotographic reproduction system 100 with a multifaceted charging mechanism 102. The electrophotographic reproduction system 100 has a photoconductor 104 that moves in the direction indicated by arrow A. The photoconductor 104 may have a belt, a drum, or other configuration. The photoconductor 104 form a continuous loop disposed on one or more rollers 106, which may be connected to a motor or similar device. The photoconductor 104 is positioned to move through or adjacent to various components of the electrophotographic reproduction system such as the multifaceted charging mechanism 102, an exposure machine 108, a development station 110, a transfer mechanism 111, and a cleaning station 114. The multifaceted charging mechanism 102 has a charger cartridge 116, a charger sleeve 118, and a charger bracket 120. The charger sleeve 118 is connected to a charger bracket 120 by an alignment mechanism 122, which holds the charger sleeve 118 adjacent to the photoconductor 104. The charger cartridge 116 is inserted into the charger sleeve 118. The charger cartridge 116 has a plurality of facets or sides, each with a corona charger disposed thereon. The charger cartridge 116 is placed in the charger sleeve 118 to position a facet adjacent to the photoconductor 104. The facet facing the photoconductor 104 may be changed so that a different corona charger on another facet may face the photoconductor 104. The charger bracket 120 may have other components such as electronic controls and circuitry for operating the multifaceted charging mechanism 102. The electrophotographic reproduction system 100 may have a logic and control unit (LCU), a graphical user interface (GUI) or other user interface, an inverter, and inserter, a finisher, and the like. While particular configurations are shown, the electrophotographic reproduction system 100 may have other configurations including those with additional components.

The charger cartridge 116 has multiple facets that have a corona charger. There may be two facets arranged in a rectangular configuration. There may be three facets arranged in a triangular configuration. There may be four facets arranged in a square configuration. The charger cartridge 116 may have other multiples of facets and other configurations. The charger cartridge 116 may have other facets or sides that do not have a corona charger. Each corona charger is electrically isolated from the other corona chargers on the charger cartridge 116. When the charger cartridge 116 is inserted in the charger sleeve 118, the facet facing the photoconductor 104 may be physically isolated from the other facets to reduce or eliminate dust and other contaminants from reaching the other corona chargers. The physical isolation may be formed by a substantially air-tight seal, a substantially dust-free seal, a mechanical interface, or the like between the facets. The physical isolation also may be formed or enhanced by maintaining a higher air pressure next to the facets that are not facing the photoconductor.

In operation, the photoconductor 104 moves through the electrophotographic reproduction system 100 on rollers 106. The multifaceted charger mechanism 102 electrostatically charges a frame or portion on the surface of the photoconductor 104. The exposure machine 108 optically exposes or projects an image onto the photoconductor 104, causing an electrostatic latent image to form on the frame with the charged surface. The photoconductor 104 moves the electrostatic latent image through the development station 110, which deposits toner onto the electrostatic image. The toner is electrostatically charged and thus adheres to the oppositely-charged portions of the electrostatic latent image. The photoconductor 104 then moves the resulting toner image through the transfer mechanism 111, where a transfer roller 112 transfers the toner image onto a sheet of paper or other medium S from a supply tray 129. In the transfer mechanism 111, the paper passes through a fuser device 113 prior to exiting the electrophotographic reproduction system 100. The fuser device affixes the toner to the paper using elevated temperature and pressure. The photoconductor 104 then is refreshed at the cleaning station 114 in preparation for the next image transfer. The cleaning station 114 removes residual toner and electrostatic charges from the photoconductor 104.

Initially, the multifaceted charger mechanism 102 has a first facet of the charger cartridge 116 facing the photoconductor 104. The first facet has a first corona charger that electrostatically charges the surface of the photoconductor 104 during the reproduction of a first set of images. Subsequently, the charger cartridge 116 is repositioned in the charger sleeve 118 so that a second facet faces the photoconductor 104. The second facet has a second corona charger that electrostatically charges the surface of the photoconductor 104 during the reproduction of a second set of images. If the charger cartridge 116 has additional facets with corona chargers, the charger cartridge 116 is repositioned for the additional corona chargers to electrostatically charge the surface of the photoconductor in similar fashion during the reproduction of additional sets of images. Unless the charger cartridge 116 is replaced sooner or reused, the repositioning of the charger cartridge 116 in the charger sleeve 118 continues until all the corona chargers are used.

After one or more of the corona chargers are used, the charger cartridge 116 is removed from the charger sleeve 118. A new or reconditioned charger cartridge is installed in the charger sleeve 118. The used charger cartridge is reconditioned or discarded. The used charger cartridge may be reconditioned by a service technician or similarly trained person at a customer site, at a manufacturing or service facility for the electrophotographic system, or like places. A reconditioned charger cartridge includes charger cartridges where one or more of the wires or other components have been replaced.

To reposition or change from one facet to another facet, the charger cartridge 116 may be removed from the charger sleeve 118. The charger cartridge 116 then is rotated and reinserted into the charger sleeve 118 such that the other facet with the other corona charger is in position to electrostatically charge the photoconductor 104. The charger sleeve 118 also may be configured to rotate the charger cartridge without removing it. The change from one facet to another facet in the charger cartridge 116 may be done by other manual or mechanical devices. The change may happen in response to a signal from a logic control unit. The change may occur when the wires in a corona charger become deteriorated or contaminated. The change may occur as part of a regular or preventive maintenance program. The change may occur at any time.

The multifaceted charging mechanism 102 has an alignment mechanism 122 connected between the charger bracket 120 and the charger sleeve 118. The alignment mechanism 122 moves or places the charger sleeve 118 into essentially the same position adjacent to the photoconductor 104. The alignment mechanism 122 has a biasing latch 124, a pin 126, and bolts 128. The pin 126 connects the biasing latch 124 to the charger bracket 120. The bolts 128 slidably connect the charger sleeve 118 to the charger bracket 120. Slidably connected includes axial movement or sliding along the bolts 128. Each of the bolts 128 may have a spring device 131 mounted between the charger sleeve 118 and the charger bracket 120.

The biasing latch 124 moves the charger sleeve 118 along the bolts 128, either away from or toward the charger bracket 120. The biasing latch 124 has a lever element 123 connected to a cam element 125. The lever element 123 rotates the cam element 125 around the pin 126. The cam element 125 engages the charger sleeve 118. The cam element 125 has an irregular-shaped circumference that translates the rotational motion of the lever element 123 into a reciprocating motion of the charger sleeve 118 along the bolts 128. When the lever element 123 closes, the cam element 125 moves the charger sleeve 118 away from the charger bracket 120 thus pushing one or more guides or stops 140 against a stop bracket 127. There may be other guides or stops on the charging mechanism 122 and the electrophotographic reproduction system 100. The stop bracket 127 is mounted at a location to position the charger sleeve 118 adjacent to the photoconductor 104. The lever element 123 may be positioned to hold the charger cartridge 116 in the charger sleeve 118 when the biasing latch 124 is closed. When the lever element 123 opens, the cam element 125 releases the charger sleeve 118 from the stops and permits movement of the charger sleeve 118 along the bolts 128 toward the charger bracket 120. The biasing latch 124 may have other configurations and components including those using a spring.

When the lever element 123 is closed, the biasing latch 124 holds the charger sleeve 118 away from the charger bracket 120 and holds the stops 140 against the stop bracket 127. The location of the charger bracket 120 in the electrophotographic reproduction system 100 may be selected such that the charger sleeve 118 is adjacent to the photoconductor 104 when the lever element 123 is closed. The charger bracket 120 may maintain an essentially fixed position once the electrophotographic reproduction system 100 is assembled. The position of the charger bracket 120 may be adjusted when removed for maintenance or replacement. The position of the charger bracket 120 also may be adjusted to maintain the alignment of the charging mechanism 122 with other components in the electrophotographic reproduction system 100.

When the biasing latch 124 is closed, the charger sleeve 118 is positioned adjacent to the photoconductor 104. The charger sleeve 118 holds the charger cartridge 116 in a position where the corona charger on one facet can apply a substantially uniform electrostatic charge across the surface of the photoconductor 104. When the biasing latch 124 is opened, the charger sleeve 118 may be moved away from the photoconductor 104 to change the facet of charger cartridge 116. After the facet is changed, the biasing latch 124 is closed. The charger sleeve 118 returns to essentially the same position as prior to the change. The new facet and corona charger are in essentially the same positions as the old facet and corona charger before the change. Similarly, the new corona charger can apply a substantially uniform electrostatic charge across the surface of a photoconductor 104.

Figure 2:
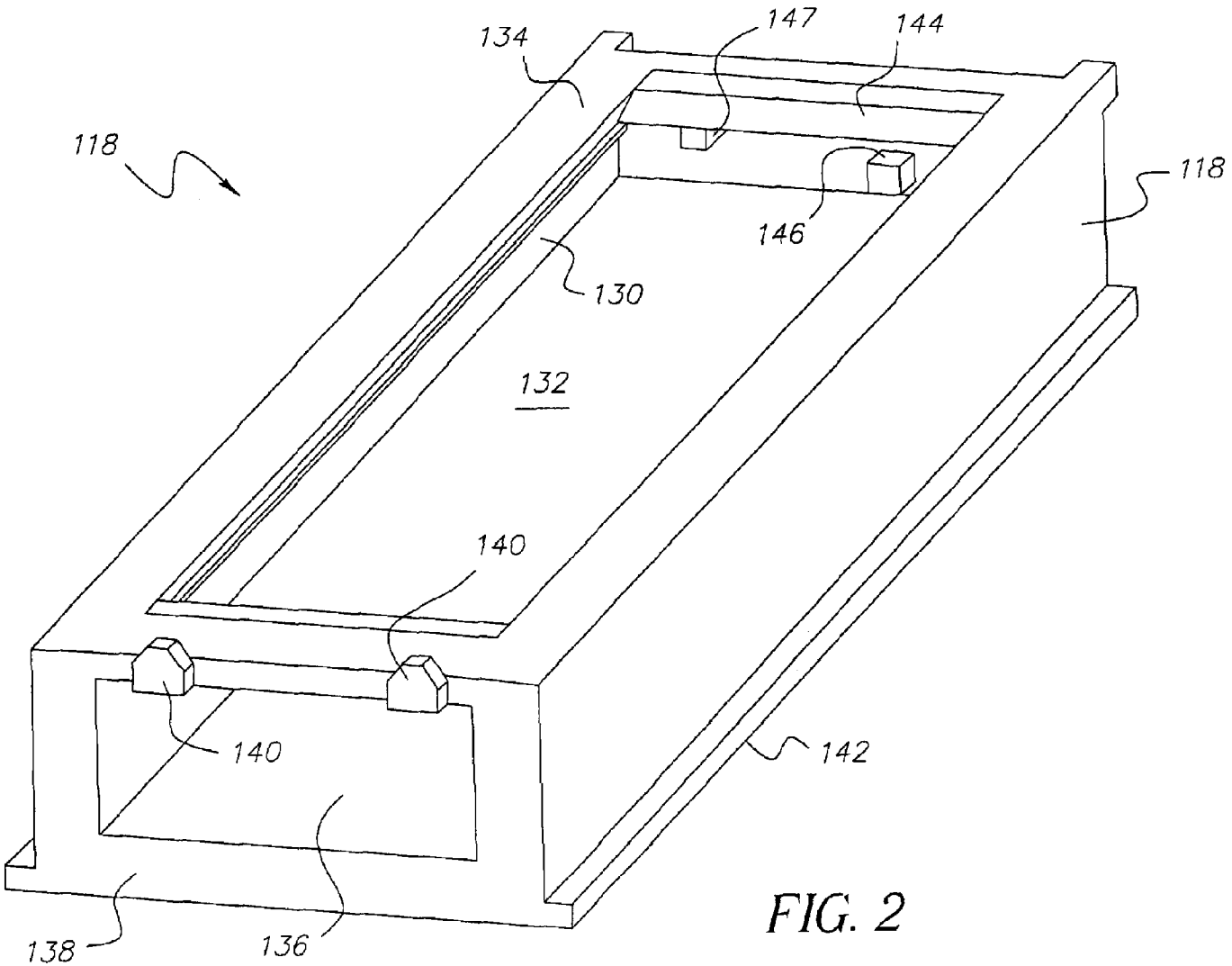
FIG. 2 is a bottom, perspective view of a charger sleeve of the multifaceted charging mechanism shown in FIG. 1.
Figure 3:
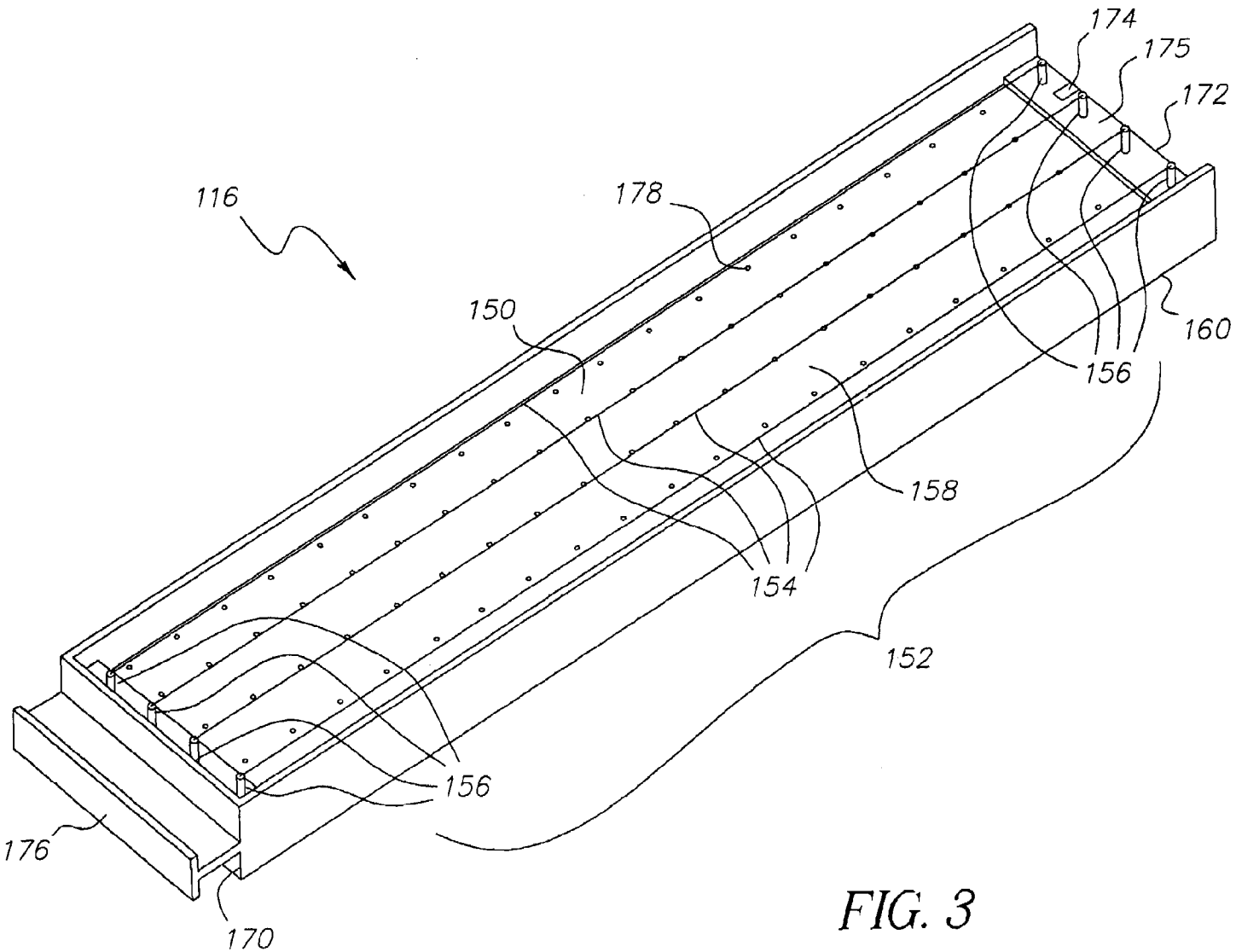
FIG. 3 is a front, perspective view of a first facet of the charger cartridge of the multifaceted charging mechanism shown in FIG. 1.
Figure 4:
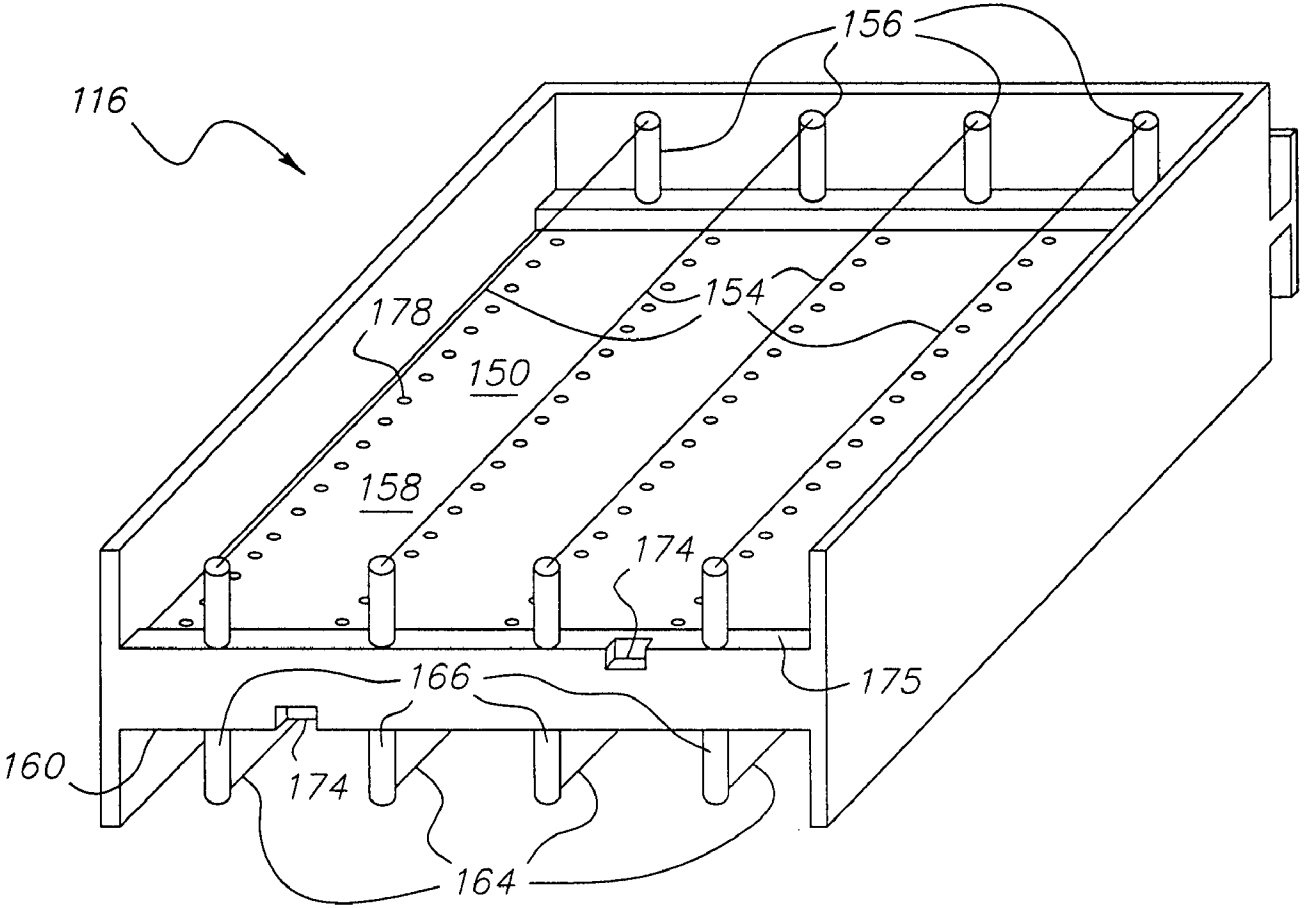
FIG. 4 is a back, perspective view of the first facet of the charger cartridge shown in FIG. 3.
Figure 5:
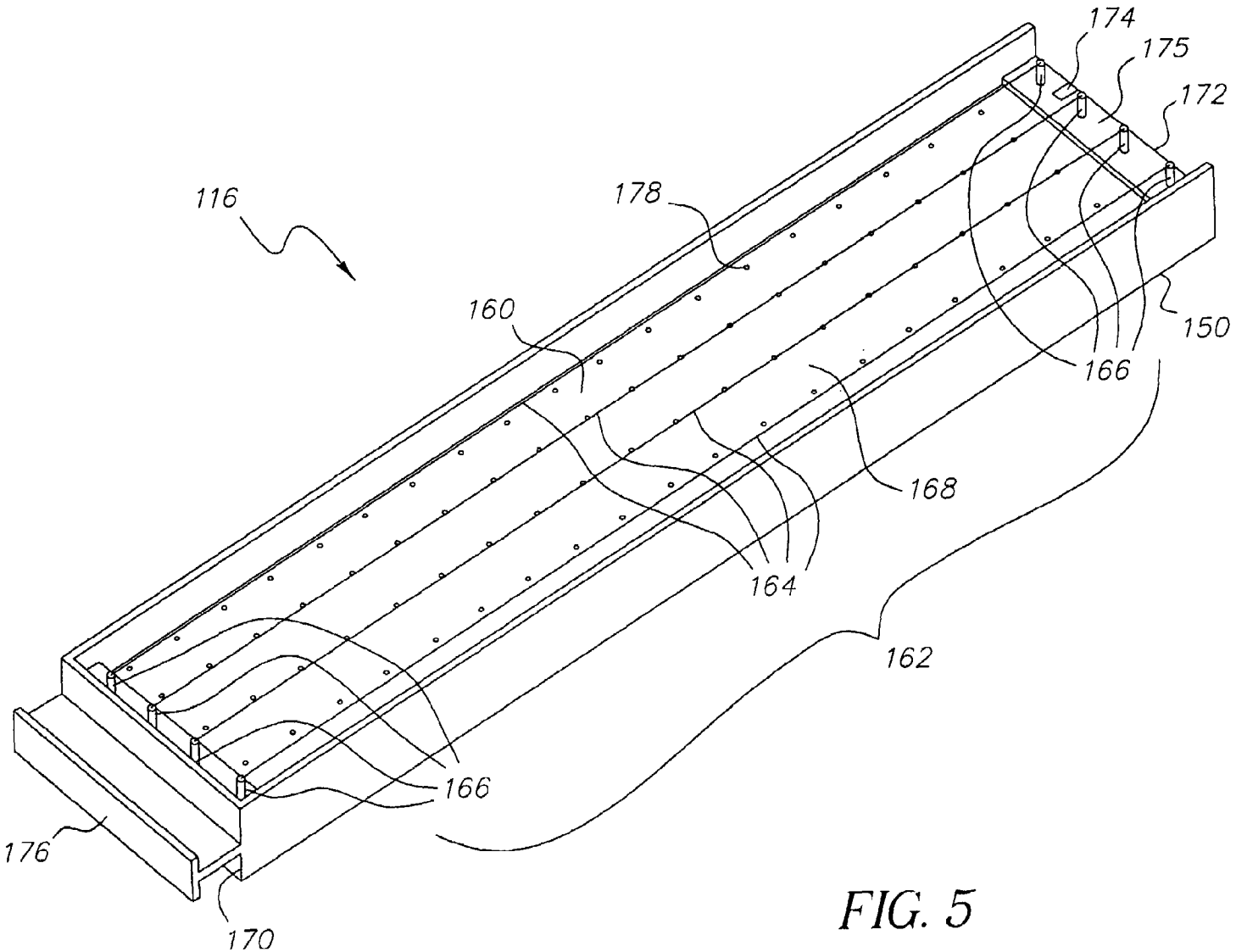
FIG. 5 is a front, perspective view of a second facet of the charger cartridge of the multifaceted charging mechanism shown in FIG. 1.
Figure 6:
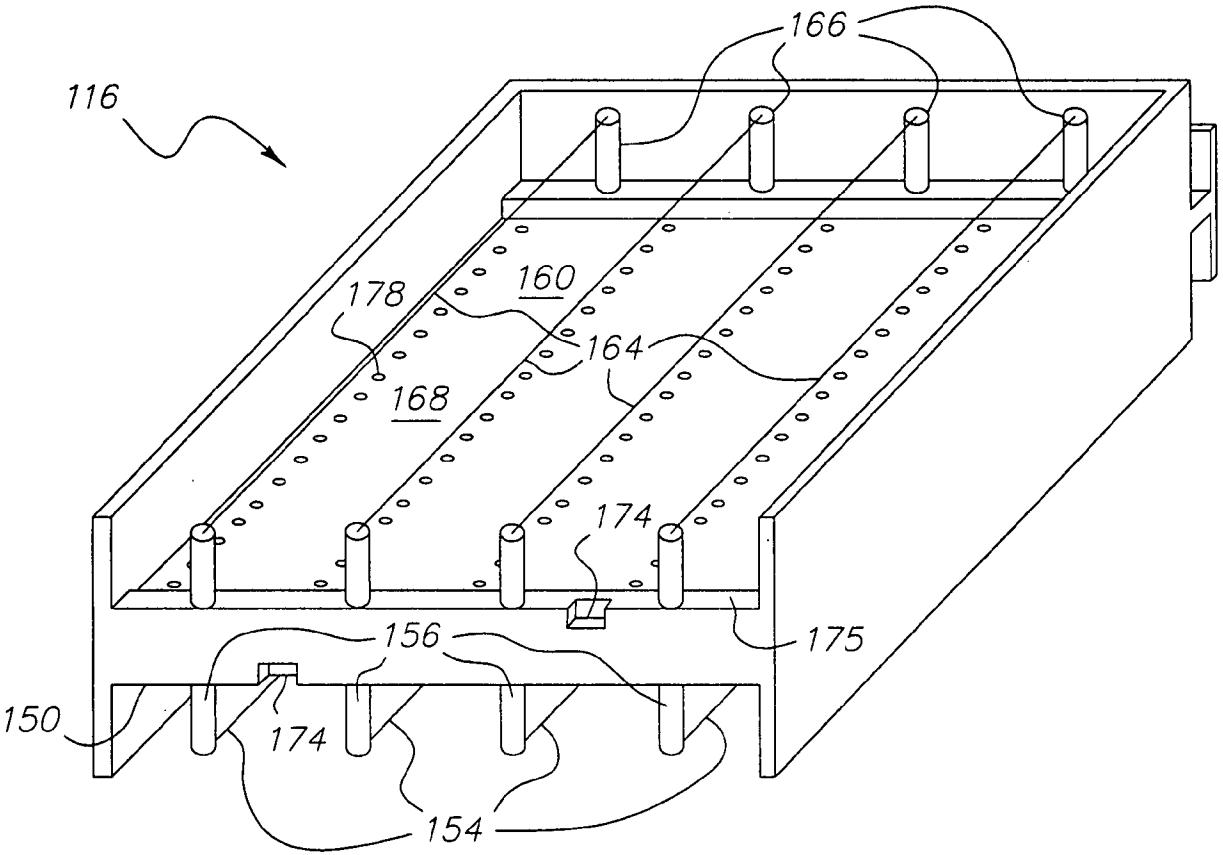
FIG. 6 is a back, perspective view of the second facet of the charger cartridge shown in FIG. 5.

FIG. 2 is a bottom, perspective view of the charger sleeve 118 for the multifaceted charging mechanism 102 shown in FIG. 1. The charger sleeve 118 forms a partially enclosed channel 130 with an aperture 132 on the bottom 134 and an opening 136 on the front side 138. The bottom 134 faces the photoconductor 104 when the charger sleeve 118 is installed in the electrophotographic reproduction system 100. The charger sleeve 118 may have one or more guides or stops 140 to assist alignment with the photoconductor 104. The top 142 of the charger sleeve 118 connects to the charger bracket 120. The charger sleeve 118 may have a grid electrode 144 (partially removed to show interior) covering the aperture 132. Covering includes partial and complete covering of the aperture. The grid electrode 144 may be a plate or sheet of conductive material with slits or holes such as a mesh, screen, or the like. The grid electrode 144 may be a plurality or network of wires. The grid electrode 144 may be connected to electrical and control circuitry and controls (not shown). The channel 130 is configured to receive and hold the charger cartridge 116 when it is inserted into the charger sleeve 118.

The charger sleeve 118 may have one or more alignment posts 146 and a contact post 147 on the inside of the channel 130. The alignment posts 146 interface with notches on the charger cartridge 116. The alignment posts 146 align and hold the charger cartridge 116 within the channel 130. The alignment posts may be made of an insulative material. The contact post 147 is positioned inside the channel 130 along the side of the cartridge sleeve 118 facing the photoconductor. The contact post 147 has a post electrical contact that interfaces with a notch on the facet of the charger cartridge 116 facing the photoconductor. This interface completes the electrical connection for applying a voltage potential to the wires in the corona charger on the facet facing the photoconductor 104.

FIGS. 3-6 show various views of the charger cartridge 116 for the multifaceted charging mechanism 102 shown in FIG. 1. The charger cartridge 116 has a first facet or side 150 and a second facet or side 160. The first facet 150 has a first corona charger 152 disposed thereon. The second facet has a second corona charger disposed thereon. The first corona charge 152 and the second corona chargers 162 are electrically isolated. The charger cartridge 116 may have additional facets, each with a corona charger disposed thereon. The first and second corona chargers 152 and 162 may have other arrangements and configurations including those with different components.

The first corona charger 152 has first wires 154, first support members 156, and a first base electrode or ground plane 158. There may be one or more first wires 154. Each of the first wires 154 is held in tension between a pair of the first support members 156. The tension in the first wires 154 may be provided by machine winding of the wires on the first support members 156. The tension in the first wires 154 may be provided by one or more springs connected to the first wires 152 on the first support members 156. The first wires 154 may be formed by a continuous wire or by individual wires spanning the first support members 156. The first wires 154 may be electrically connected through the first support members to electrical contacts in a notch on the facet holding the corona charger. The first wires 154 are suspended above the first base electrode 158. The first wires 154 and the first base electrode 156 may be connected to electrical and control circuitry and controls (not shown) located in the charger bracket 120.

The second corona charger 162 has second wires 164, second support members 166, and a second base electrode or ground plane 168. There may be one or more second wires 164. Each of the second wires 164 is held in tension between a pair of the second support members 166. The tension in the second wires 164 may be provided by machine winding of the wires on the second support members 166. The tension in the second wires 164 may be provided by one or more springs connected to the second wires 162 on the second support members 166. The second wires 164 may be formed by a continuous wire or by individual wires spanning the second support members 166. The second wires 164 may be electrically connected through the second support members to electrical contacts in a notch on the facet holding the corona charger. The second wires 164 are suspended above the second base electrode 168. The second wires 164 and the second base electrode 166 may be connected to electrical and control circuitry and controls (not shown) located in the charger bracket 120.

The charger cartridge 116 has a front section 170, a back section 172, and a base 175. The front section 170 is connected to a handle 176. The back section 172 and base 175 may form one or more notches 174 for each facet with a corona charger.

The notches 174 receive the alignment posts 146 and the contact post 147 when the charger cartridge 116 is inserted into the charger sleeve 118. Each notch 174 has a notch electrical contact that can interface with the post electrical contact on the contact post 147. The notch electrical contacts may be connected to a power or voltage supply and electrical circuitry and controls. The post electrical contact interfaces with the notch electrical contact on the facet facing the photoconductor 104 when the charger cartridge 116 is inserted into the charger sleeve 118. This interface provides an electrical connection for applying a high voltage potential to the wires of the corona charger on the facet facing the photoconductor 104. The other notches 174 interface with the alignment posts 146, which may prevent electrical connections to the corona chargers on facets not facing the photoconductor 104. When the charger cartridge 116 is repositioned, the notch 174 that was connected to the contact post 147 now connects to an alignment post 146. Similarly, the notch 174 of the new facet now facing the photoconductor 104 now connects with the contact post 147. A high voltage potential may be applied to the wires of the corona charger on the new facet facing the photoconductor 104.

The first support members 156 and the first base electrode 158 are disposed on one side of the base 175. The second support members 166 and the second base electrode 168 are disposed on the other side of the base 175. The base 175 may be made of an electrically insulative material. The base 175 may have an electrically insulating layer between the first base electrode 158 and the second base electrode 168. The base 175 may have a plurality of holes 178 to assist airflow in the charger sleeve 118. The charger cartridge 116 may have a cartridge grid electrode, which may be in addition to or instead of the grid electrode 144 in the charger sleeve 118.

Figure 7:
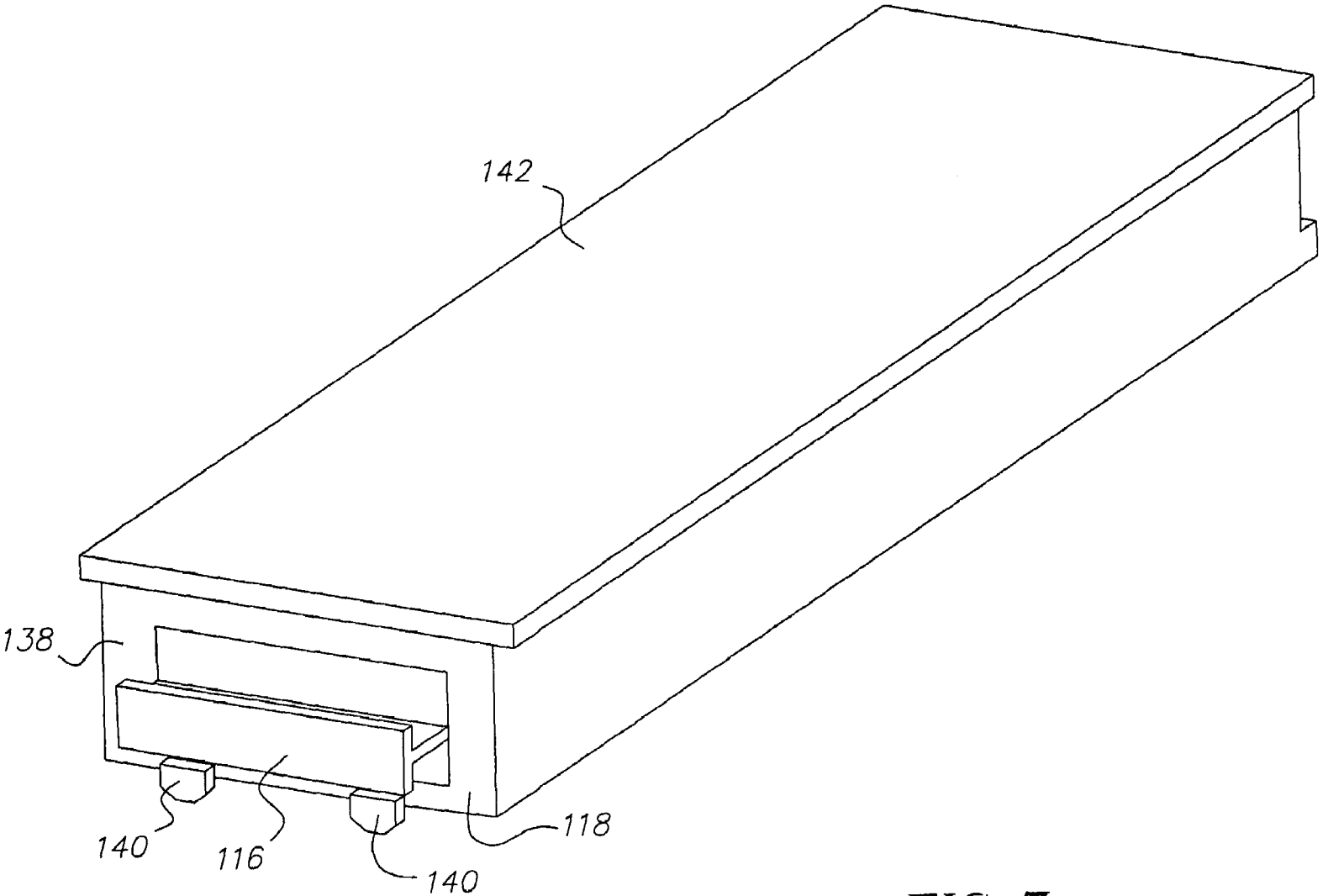
FIG. 7 is a top, perspective view of an assembled charger sleeve and charger cartridge of the multifaceted charging mechanism shown in FIG. 1.
Figure 8:
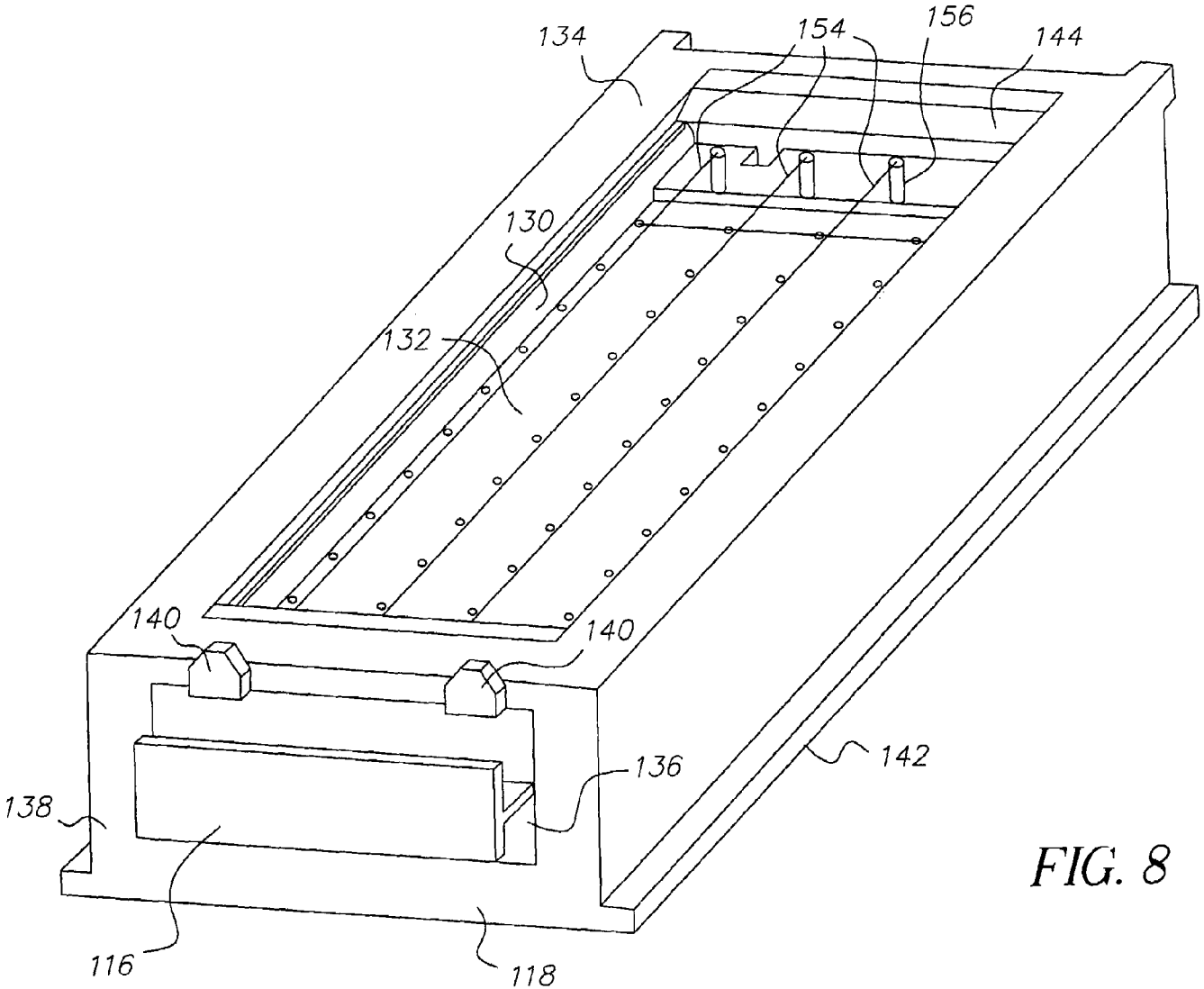
FIG. 8 is a bottom, perspective view of the assembled charger sleeve and charger cartridge shown in FIG. 7.

FIGS. 7 and 8 are various views of the assembled charger cartridge 116 and charger sleeve 118. To assemble, the back section 172 of the charger cartridge 116 is aligned with the opening in the charger sleeve 118 such that the desired facet and associated corona charger face toward the bottom 134 of the charger sleeve 118. The charger cartridge 116 is inserted into the opening 136 of the charger sleeve 118 and then pushed or slid along the channel 130. Thus, the desired facet and corona charger of the charger cartridge 116 are positioned next to the aperture 132 in the bottom 134 of the charger sleeve 118. The wires and base grid of the desired corona charger are connected to electrical circuitry and controls (not shown) for operation of the desired corona charger. The notches 174 in the charger cartridge 116 receive or mesh with the posts 146 in the charger sleeve 118. The notches 174 and posts 146 may have electrical contacts for connecting the wires and base grid to the electrical circuitry and controls.

When assembled, the front section 170 of the charger cartridge 116 may be disposed within the opening 136 in the front side 138 of the charger sleeve 118. The front section 170 of the charger cartridge 116 may be disposed adjacent or against the front side 138 of the charger sleeve 118. The front section 170 and the front side 138 may form a substantially air tight seal. The front section 170 and the front side 138 may form a substantially dust-free seal where air may pass, but where dust and other particles do not pass. The front section 170 and front side 138 may be connected, but not form any seal. The sleeve charger 118 may have a positive pressure from an air supply, fan, or the like.

Figure 9:
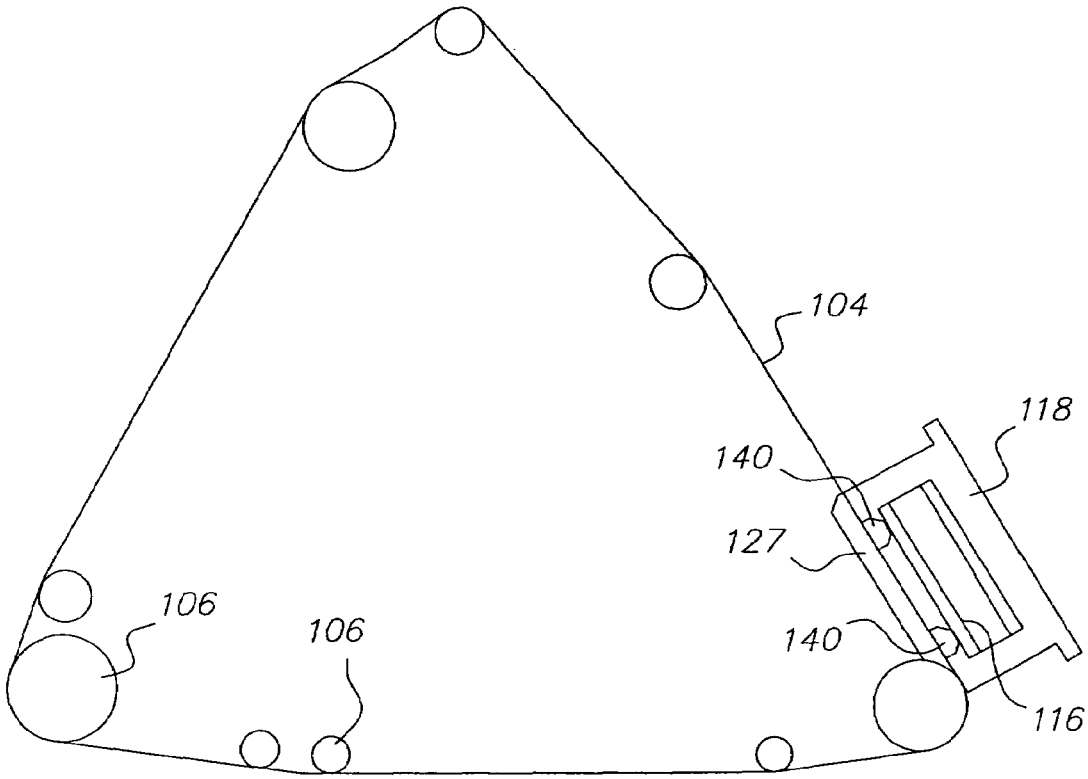
FIG. 9 is a schematic view of the charger sleeve and charger cartridge as assembled and positioned adjacent to the photoconductor of the electrophotographic reproduction system of FIG. 1.

FIG. 9 is a schematic view of the assembled charger cartridge 116 and charger sleeve 118 positioned adjacent to the photoconductor 104 of the electrophotographic reproduction system 100. The guides or stops 140 on the front side 138 of the charger sleeve 118 are aligned along an edge of the photoconductor 104. The bottom 134 of the charger sleeve 118 is adjacent to the photoconductor 104, thus positioning desired facet of charger cartridge 116 to view the photoconductor 104 through the aperture 132 in the cartridge sleeve 118. When a high voltage potential is applied to the desired corona charger on the charger cartridge 116, current flows from the corona charger to the photoconductor 104 to generate an electrostatic charge on the surface of the photoconductor 104. A bias voltage may be applied to the grid electrode 144 in the charger sleeve 118 to control the current flow from the corona charger.

When the charger cartridge 116 is removed from the charger sleeve 118, the charger sleeve 118 may remain adjacent to the photoconductor 104 and may remain connected to the charger bracket 120 in the electrophotographic reproduction system. The charger cartridge 116 may be repositioned to expose another facet and corresponding corona charger through the aperture 132 to the photoconductor 104. The repositioning may include removing, rotating, and reinserting the charger cartridge. The repositioning may include rotating the charger cartridge in place. The charger cartridge 116 may be replaced by a new charger cartridge. The old charger cartridge may be reconditioned by a service technician, at the factory, or the like. Reconditioning would include the replacement of the wires and other components as needed.

Figure 10:
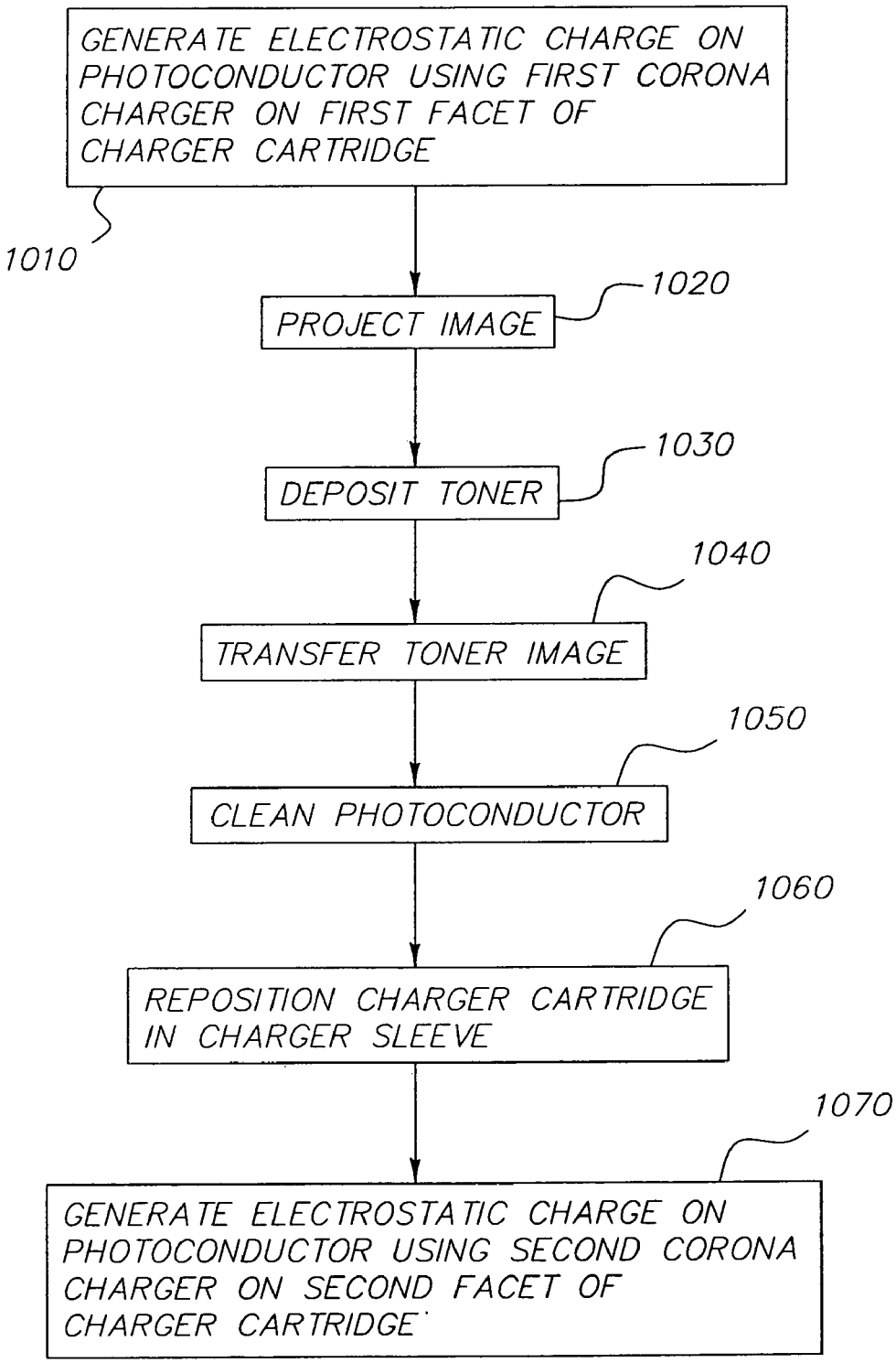
FIG. 10 is a flowchart of a method for electrophotographically reproducing images.

FIG. 10 is a flowchart of a method for electrophotographically reproducing images. In block 1010, a first corona charger generates an electrostatic charge on the surface of a photoconductor as previously discussed. The first corona charger is on a first facet of a charger cartridge in a multifaceted charging mechanism. A high voltage potential is applied to the first corona charger causing current to flow to the photoconductor and thus generate the electrostatic charge on the surface. In block 1020, an image is projected onto the electrostatic charge on the photoconductor. The image causes an electrostatic latent image to form on the surface of the photoconductor. In block 1030, toner is deposited onto the electrostatic latent image. The toner adheres to the electrostatic image to create a toner image on the surface of the photoconductor. In block 1040, the toner image is transferred onto a sheet of paper or other medium. The toner image is fused onto the paper by elevated temperature and pressure. In block 1050, the photoconductor is cleaned to remove residual toner and electrostatic charges. In block 1060, the cartridge charger is repositioned in the charger sleeve of the multifaceted charging mechanism as previously discussed. A second corona charger faces the photoconductor. The second corona charger is on a second facet of the charger cartridge. In block 1070, the second corona charger generates another electrostatic charge on the surface of the photoconductor. A high voltage potential is applied to the second corona charger causing current to flow to the photoconductor and thus generate the electrostatic charge.

While various embodiments of the invention have been described, it will be apparent to those of ordinary skill in the art that other embodiments and implementations are possible within the scope of the invention. Accordingly, the invention is not to be restricted except in light of the attached claims and their equivalents.

PARTS LIST

A direction of photoconductor travel
GUI graphical user interface
LCU logic and control unit
S Sheet
100 electrophotographic reproduction system
102 multifaceted charging mechanism
104 photoconductor
106 rollers
108 exposure machine
110 development station
111 transfer mechanism
112 transfer roller
113 fuser device
114 cleaning station
116 charger cartridge
118 charger sleeve
120 charger bracket
122 alignment or charging mechanism
123 lever element
124 biasing latch
125 cam element
126 pin

127 stop bracket
128 bolts
129 supply tray
130 channel
131 spring device
132 aperture
134 bottom
136 opening
138 front side
140 guides or stops
142 top
144 grid electrode
146 alignment post or posts
147 contact post
150 first facet or side
152 first corona charger
154 first wires
156 first support members
158 first base electrode or ground plane
160 second facet or side
162 second corona chargers
164 second wires
166 second support members
168 second base electrode or ground plane 168
170 front section
172 back section
174 notches
175 base
176 handle
178 holes

The invention claimed is:

1. An electrophotographic reproduction system, comprising:

a photoconductor; and a charging mechanism having a charger sleeve and a charger cartridge, where the charger sleeve forms a channel with an aperture, where the aperture is positioned adjacent to the photoconductor; and where the charger cartridge has a first facet and a second facet, where the first facet has a first corona charger disposed thereon, where the second facet has a second corona charger disposed thereon, where the charger cartridge is positioned within the channel of the charger sleeve to have the first facet face the aperture, where the charger cartridge may be repositioned in the channel to have the second facet face the aperture.

2. The electrophotographic reproduction system of claim 1, where the first facet has a first base electrode connected to the base, where the first facet has at least one first wire held in tension by a pair of first support members connected to the base, where the at least one first wire is suspended above the first base electrode;

where the second facet has a second base electrode connected to the base, where the second facet has at least one second wire held in tension by a pair of second support members connected to the base, where the at least one second wire is suspended above the second base electrode; and where the first and second base electrodes are electrically isolated from each other.

3. The electrophotographic reproduction system of claim 2, where the first facet has four first wires, where each first wire is held in tension by a pair of first support members, where the second facet has four second wires, where each second wire is held in tension by a pair of second support members, and where the charger sleeve has a grid electrode covering the aperture.

4. The electrophotographic reproduction system of claim 3, where the first four wires comprise a first continuous wire, and where the second four wires comprise a second continuous wire.

5. The electrophotographic reproduction system of claim 1, where the charger cartridge may be removed from the charger sleeve.

6. The electrophotographic reproduction system of claim 1, where the charger sleeve has a contact post and at least one alignment post, where the charger cartridge has at least two notches, and where the at least two notches interface with the contact post and at least one alignment post when the charger cartridge is positioned inside the charger sleeve.

7. The electrophotographic reproduction system of claim 6, where the contact post has a post electrical contact, where each notch has a notch electrical contact, where the post electrical contact interfaces with one of the notch electrical contacts, and where the interface between the post and notch electrical contacts provides an electrical connection for applying a voltage potential to one of the first and second corona charges.

8. The electrophotographic reproduction system of claim 1, where the charging mechanism further comprises:

a charger bracket connected to the charger sleeve; and an alignment mechanism connected to the charger bracket and the charger sleeve, where the alignment mechanism moves the charger sleeve into a position adjacent to the photoconductor.

9. The electrophotographic reproduction system of claim 8, where the alignment mechanism comprises:

biasing latch and at least one bolt, where the charger bracket is slidably connected to the charger sleeve on the at least one bolt, where the biasing latch has a lever element and a cam element; and where the cam element translates a rotational movement of the lever element into a reciprocating motion of the charger sleeve on the at least one bolt.

10. The electrophotographic reproduction system of claim 9, further comprising at least one stop, where the cam element moves the charger sleeve against the at least one stop when the lever element rotates.

11. The electrophotographic reproduction system of claim 1, further comprising an exposure machine, a development station, and a transfer mechanism, where the exposure machine projects an image onto the photoconductor, where the development station deposits toner onto the photoconductor, and where the transfer mechanism transfers a toner image from the photoconductor onto a medium.

12. A charging mechanism for an electrophotographic reproduction system, comprising:

a charger sleeve forming a channel with an aperture; and a charger cartridge having at least two facets, where each facet has a corona charger disposed thereon, where the charger cartridge is positioned within the channel of the charger sleeve to have one facet face the aperture, where the charger cartridge may be repositioned in the channel to have another facet race the aperture.

13. The charging mechanism of claim 12, where the corona charger comprises at least one wire held in tension by a pair of support members, where the at least one wire is suspended above a base electrode.

14. The charging mechanism of claim 13, where the at least one wire comprises a continuous wire held in tension by each pair of support members.

15. The charging mechanism of claim 13, where the at least one wire comprises individual wires held in tension by each pair of support members.

16. The charging mechanism of claim 7, where the charger sleeve has a grid electrode covering the aperture.

17. The charging mechanism of claim 7, where each corona charger is electrically isolated from other corona chargers.

18. The charging mechanism of claim 12, where the corona charger comprises four wires, where each wire is held in tension by a pair of support members, where the four wires are suspended above the base electrode, and where the charger sleeve has a grid electrode covering the aperture.

19. The charging mechanism of claim 12, where the charging mechanism further comprises:

a charger bracket connected to the charger sleeve; and an alignment mechanism connected to the charger bracket and the charger sleeve, where the alignment mechanism moves the charger sleeve.

20. The charging mechanism of claim 19, where the alignment mechanism comprises:

biasing latch and at least one bolt, where the charger bracket is slidably connected to the charger sleeve on the at least one bolt, where the biasing latch has a lever element and a earn element; and where the cam element translates a rotational movement of the lever element into a reciprocating motion of the charger sleeve on the at least one bolt.

21. The charging mechanism of claim 20, further comprising at least one stop, where the cam element moves the charger sleeve against the at least one stop when the lever element rotates.

22. The charging mechanism of claim 21, where the at least one stop comprises a retaining lip formed by the charger bracket.

23. The charging mechanism of claim 12, where the charger cartridge comprises a first facet and a second facet on opposite sides of a base, where the first facet has a first base electrode connected to the base, where the first facet has at least one first wire held in tension by a pair of first support members connected to the base, where the at least one first wire is suspended above the first base electrode, where the second facet has a second base electrode connected to the base, where the second facet has at least one second wire held in tension by a pair of second support members connected to the base, where the at least one second wire is suspended above the second base electrode; and where the first and second base electrodes are electrically isolated from each other.

24. The charging mechanism of claim 23, where the charger sleeve has a contact post and an alignment post, where the charger cartridge has a first notch and a second notch, where the first notch is on the first facet, where the second notch is in the second facet, where the first notch interfaces with the contact post when the first facet is adjacent to the apertures, where the second notch interfaces with the alignment post when the first facet is adjacent to the aperture, where the second notch interfaces with the contact post when the second facet is adjacent to the aperture; and where the first notch interfaces with the alignment post when the second facet is adjacent to the aperture.

25. The charging mechanism of claim 24, where the contact post has a post electrical contact, where each notch has a notch electrical contact, where the post electrical contact interfaces with the first notch electrical contact when the first facet is adjacent to the aperture where the interface between the post electrical contact and the first notch electrical contact provides an electrical connection for applying a voltage potential to a first corona charger on the first facet, where the post electrical contact interfaces with the second notch electrical contact when the second facet is adjacent to the aperture; and where the interface between the post electrical contact and the second notch electrical contact provides another electrical connection for applying a voltage potential to a second corona charger on the second facet.

26. The charging mechanism of claim 12, where the first facet comprises four first wires, where each first wire is held in tension by a pair of first support members, where the second facet comprises four second wires, and where each second wire is held in tension by a pair of second support members.

27. The charging mechanism of claim 12, where the charger cartridge may be removed from the charger sleeve.

28. The charging mechanism of claim 12, where the charger sleeve forms at least one post, where the charger cartridge forms at least one notch, where the post interfaces with the notch when the charger cartridge is in the channel of the charger sleeve.

29. The charging mechanism of claim 12, where the charger sleeve has a front side forming an opening, where the charger cartridge has front section positioned within the opening, where the front side has a substantially air-tight seal with the front section.

30. The charging mechanism of claim 12, where the charger sleeve has a front side forming an opening, where the charger cartridge has front section positioned within the opening, where the front side has a substantially dust-free seal with the front section.

* * * * *

UNITED STATES PATENT AND TRADEMARK OFFICE

CERTIFICATE OF CORRECTION

PATENT NO. : 7,295,793 B2
APPLICATION NO. : 11/081426
DATED : November 13, 2007
INVENTOR(S) : Daniel R. Palmer et al.

It is certified that error appears in the above-identified patent and that said Letters Patent is hereby corrected as shown below:

Column 12, Line 28, delete “charges” and insert --chargers--

Column 12, Line 65, delete “race” and insert --face--

Column 13, Line 30, delete “earn” and insert --cam--

Signed and Sealed this

Thirtieth Day of December, 2008

JON W. DUDAS
*Director of the United States Patent and Trademark Office*